US006779866B2

(12) United States Patent
Junhua et al.

(10) Patent No.: US 6,779,866 B2
(45) Date of Patent: Aug. 24, 2004

(54) LIQUID JETTING APPARATUS AND METHOD FOR DRIVING THE SAME

(75) Inventors: Chang Junhua, Nagano (JP); Tsuyoshi Kitahara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 2 days.

(21) Appl. No.: 10/314,451

(22) Filed: Dec. 9, 2002

(65) Prior Publication Data

US 2003/0117454 A1 Jun. 26, 2003

(30) Foreign Application Priority Data

Dec. 11, 2001 (JP) ..... 2001-376760
Dec. 18, 2001 (JP) ..... 2001-384068
Dec. 21, 2001 (JP) ..... 2001-389209
Dec. 10, 2002 (JP) ..... 2002-357529
Dec. 12, 2002 (JP) ..... 2002-360704

(51) Int. Cl.[7] ..... B41J 29/393
(52) U.S. Cl. ..... 347/19
(58) Field of Search ..... 347/19, 10, 5, 347/6, 8, 9, 12, 11, 14, 68, 67, 58, 57, 56, 20, 43, 70; 358/298, 296; 400/88, 691, 692, 693

(56) References Cited

U.S. PATENT DOCUMENTS 5,343,231 A * 8/1994 Suzuki ..... 347/14
6,033,137 A * 3/2000 Ito ..... 400/74

FOREIGN PATENT DOCUMENTS

EP 0 072 685 A1 2/1983
EP 0 621 135 A1 10/1994
EP 1 088 662 A2 4/2001
JP 10-81012 3/1998
JP 11-78005 A 3/1999
JP 2000-52570 2/2000
JP 2000-218834 A 8/2000
JP 2001-26102 A 1/2001
JP 2001-113734 A 4/2001
JP 2001-121722 5/2001
WO 01/74595 A1 10/2001
WO 01/74596 A1 10/2001

* cited by examiner

*Primary Examiner*—Stephen D. Meier
*Assistant Examiner*—Charles Stewart
(74) *Attorney, Agent, or Firm*—Sughrue Mion, PLLC

(57) ABSTRACT

A jetting head is provided with a nozzle orifice, a pressure chamber communicated with the nozzle orifice, and a piezoelectric element which is deformable to cause pressure fluctuation to liquid contained in the pressure chamber. A drive signal generator simultaneously generates a plurality of drive signals, each provided with waveform elements including at least one drive pulse in every unit jetting cycle. The drive pulse deforms the piezoelectric element to cause such pressure fluctuation as to eject a liquid droplet from the nozzle orifice. A switcher selectively supplies at least one of the waveform elements included in one of the drive signals to the piezoelectric element. A switch controller controls a selective supply operation of the switcher in accordance with amount data which indicates an amount of the liquid droplet to be ejected. A time period in which the drive pulse is generated in one of the drive signal and that in another one of the drive signals overlap at least partly.

12 Claims, 8 Drawing Sheets

| | | | | | |
|---|---|---|---|---|---|
| GRADATION DATA 00 (VIBRATION) | t10 (LAT1) | t11 (CH11) | t12 (CH12) | t13 (CH13) | (1100) |
| | ○ | ○ | × | × | |
| | t20 (LAT1) | t21 (CH21) | t22 (CH22) | t23 (CH23) | (0001) |
| | × | × | × | ○ | |
| GRADATION DATA 01 (SMALL DOT) | t10 (LAT1) | t11 (CH11) | t12 (CH12) | t13 (CH13) | (0000) |
| | × | × | × | × | |
| | t20 (LAT1) | t21 (CH21) | t22 (CH22) | t23 (CH23) | (1111) |
| | ○ | ○ | ○ | ○ | |
| GRADATION DATA 10 (MIDDLE DOT) | t10 (LAT1) | t11 (CH11) | t12 (CH12) | t13 (CH13) | (0001) |
| | × | × | × | ○ | |
| | t20 (LAT1) | t21 (CH21) | t22 (CH22) | t23 (CH23) | (1100) |
| | ○ | ○ | × | × | |
| GRADATION DATA 11 (LARGE DOT) | t10 (LAT1) | t11 (CH11) | t12 (CH12) | t13 (CH13) | (1111) |
| | ○ | ○ | ○ | ○ | |
| | t20 (LAT1) | t21 (CH21) | t22 (CH22) | t23 (CH23) | (0000) |
| | × | × | × | × | |

| | | | | | |
|---|---|---|---|---|---|
| GRADATION DATA 00 (VIBRATION) | t10 (LAT1) | t11 (CH11) | t12 (CH12) | t13 (CH13) | (1100) |
| | ○ | ○ | × | × | |
| | t20 (LAT1) | t21 (CH21) | t22 (CH22) | t23 (CH23) | (0001) |
| | × | × | × | ○ | |
| GRADATION DATA 01 (SMALL DOT) | t10 (LAT1) | t11 (CH11) | t12 (CH12) | t13 (CH13) | (0000) |
| | × | × | × | × | |
| | t20 (LAT1) | t21 (CH21) | t22 (CH22) | t23 (CH23) | (1111) |
| | ○ | ○ | ○ | ○ | |
| GRADATION DATA 10 (MIDDLE DOT) | t10 (LAT1) | t11 (CH11) | t12 (CH12) | t13 (CH13) | (0001) |
| | × | × | × | ○ | |
| | t20 (LAT1) | t21 (CH21) | t22 (CH22) | t23 (CH23) | (1100) |
| | ○ | ○ | × | × | |
| GRADATION DATA 11 (LARGE DOT) | t10 (LAT1) | t11 (CH11) | t12 (CH12) | t13 (CH13) | (1111) |
| | ○ | ○ | ○ | ○ | |
| | t20 (LAT1) | t21 (CH21) | t22 (CH22) | t23 (CH23) | (0000) |
| | × | × | × | × | |

LIQUID JETTING APPARATUS AND METHOD FOR DRIVING THE SAME

BACKGROUND OF THE INVENTION

The invention relates to a liquid jetting apparatus such as an ink jet recording apparatus, a display manufacturing apparatus, an electrode forming apparatus, a biochip manufacturing apparatus or the like, which can control ejection of liquid droplets from nozzle orifices by controlling supply of drive pulses to pressure generating elements in accordance with a jetting amount, as well as to a method for driving such an apparatus.

Various kinds of the liquid jetting apparatus have hitherto been known. For example, there have been known an image forming apparatus which records information on recording paper by jetting ink droplets, an electrode forming apparatus which forms an electrode on a board by jetting liquid-state electrode material, a biochip manufacturing apparatus which manufactures a biochip by jetting biological specimen, and a micropipette for jetting a predetermined amount of sample into a vessel.

A liquid jetting apparatus capable of changing the amount of liquid to be ejected from nozzle orifices with a view toward pursuing both higher-speed jetting operation and higher jetting amount accuracy has hitherto been known.

For example, an ink jet recording apparatus which is one kind of the liquid jetting apparatus has, for example, a recording head which has nozzle orifices communicating with a pressure chamber, and pressure generating elements capable of causing a change in the pressure of the ink stored in the pressure chamber; and a drive signal generator capable of producing a drive signal to be supplied to the pressure generating elements. The drive signal is a single signal formed by connecting a plurality of drive pulses into a string of pulses within one recording cycle. A required portion of the drive signal is supplied to the pressure generating element in accordance with recording data (i.e., gradation data), thereby changing the amount of ink to be ejected from a nozzle orifice. Such a configuration is disclosed in Japanese Patent Publication No. 10-81012A (see Page 9 and FIG. 9).

However, a related-art configuration in which a required portion of a single drive signal is supplied to pressure generating elements encounters difficulty in causing a jetting head (recording head) to sufficiently offer original performance thereof. More specifically, since a plurality of drive pulses are included in one jetting (recording cycle), there is no alternative but to actuate a jetting head (i.e., a pressure generating element) at a frequency lower than the maximum frequency at which the jetting head can be actuated.

SUMMARY OF THE INVENTION

It is therefore an object of the invention to provide a liquid jetting apparatus which can be constructed so as to be able to actuate a jetting head at a higher frequency, along with a method for driving such an apparatus.

In order to achieve the above object, according to the invention, there is provided a liquid jetting apparatus, comprising:

a jetting head, provided with a nozzle orifice, a pressure chamber communicated with the nozzle orifice, and a piezoelectric element which is deformable to cause pressure fluctuation to liquid contained in the pressure chamber;

a drive signal generator, which simultaneously generates a plurality of drive signals, each provided with waveform elements including at least one drive pulse in every unit recording cycle, the drive pulse deforming the piezoelectric element to cause such pressure fluctuation as to eject a liquid droplet from the nozzle orifice;

a switcher, which selectively supplies at least one of the waveform elements included in one of the drive signals to the piezoelectric element; and a switch controller, which controls a selective supply operation of the switcher in accordance with amount data which indicates an amount of the liquid droplet to be ejected, wherein a time period in which the drive pulse is generated in one of the drive signal and that in another one of the drive signals overlap at least partly.

In such a configuration, the recording cycle can be shortened as compared with that achieved when a plurality of drive pulses are included in one drive signal in the form of a single pulse train. As a result, a jetting head can be actuated at a higher frequency.

Preferably, the waveform elements in each drive signal include a drive waveform element which constitutes the drive pulse, and a constant-potential waveform element which maintains a potential of the drive signal at a leading-end potential and a trailing-end potential thereof.

Here, the switch controller may control the switcher such that the drive waveform element in one of the drive signals and the drive waveform element in another one of the drive signals are supplied to the piezoelectric element in the unit jetting cycle.

Alternatively, the switch controller may control the switcher such that the drive waveform element in one of the drive signals and the constant-potential waveform element in another one of the drive signals are supplied to the piezoelectric element in the unit jetting cycle.

Alternatively, the switch controller controls the switcher such that the constant-potential waveform element in at least one of the drive signals is supplied to the piezoelectric element in the unit jetting cycle.

Since the waveform elements of respective drive signals are supplied in combination to the pressure generating element within a jetting cycle by switch controller, a jetting head can be actuated in a new pattern which is not originally contained in respective drive signals. As a result, complicated control can be realized while the drive frequency of the jetting head is enhanced.

When the constant-potential waveform element is used, the piezoelectric element can be maintained at a constant potential. As a result, there can be prevented a drop in the potential of the piezoelectric element, which would otherwise be caused by an electric discharge. Thus, there can be prevented occurrence of failures, such as erroneous ejection of a liquid droplet.

Preferably, the switcher includes a plurality of switches interposed between the drive signal generator and the piezoelectric element such that each of the switches is associated with one of the drive signals.

Here, it is preferable that the switch controller selectively activates one of the switches such that one of the drive signals associated with an activated switch is supplied to the piezoelectric element.

Preferably, the switcher includes a plurality of input contacts each associated with one of the drive signals and an output contact electrically connected to the piezoelectric element. Here, the switch controller selectively connects one of the input contacts and the output contact such that one of the drive signals associated with a selected input contact is supplied to the piezoelectric element. In this case, the switching control can be simplified.

Preferably, the drive signals include: a first drive signal, in which at least two first drive pulses each for ejecting a first amount of liquid droplet are arranged at a predetermined interval; and a second drive signal, in which at least one second drive pulse for ejecting a second amount of liquid droplet is generated at a timing between timings at which the first drive pulses are generated. Here, the predetermined interval is determined such that the first drive pulses are still arranged at the predetermined interval even when the first drive signal is successively selected in adjacent unit jetting cycles.

In such a configuration, there can be prevented occurrence of an offset, which would otherwise arise in an interval between ejection of liquid droplets, thereby enabling an improvement in jetting amount accuracy.

Here, it is preferable that the first drive pulse including: an expanding element, in which a potential of the first drive signal is varied from a reference potential to a first potential at a constant gradient, so that a volume of the pressure chamber is expanded from a reference volume to a first volume; and first holding element, which maintains the volume of the pressure chamber at the first volume. On the other hand, the second drive pulse including: a second holding element, in which a potential of the second drive signal is maintained at the first potential to maintain the volume of the pressure chamber at the first volume; and a contracting element, in which the potential of the second drive signal is varied from the first potential to the reference potential at a constant gradient, so that the volume of the pressure chamber is contracted from the first volume to the reference volume. Here, the switch controller controls the switcher so as to supply the expanding element, the first holding element, the second holding element and the contracting element, to cause pressure fluctuation such an extent that no liquid droplet is ejected, when the amount data indicates no jetting is to be performed.

Further, it is preferable that; each of the first drive pulses is interposed between first constant-potential waveform elements which maintain a potential of the first drive signal at a reference potential so that an initial end and a termination end of each first drive pulse are set to the reference potential; the second drive pulse is interposed between second constant-potential waveform elements which maintain a potential of the second drive signal at the reference potential so that an initial end and a termination end of the second drive pulse are set to the reference potential; and the switch controller controls the switcher so as to supply one of the first drive pulses and one of the second constant-potential waveform element, so that a potential of the piezoelectric vibrator is set to the reference potential while the first drive pulse is not supplied, when the amount data indicates the first amount of liquid droplet to be ejected.

According to the invention, there is also provided a method of driving a liquid jetting apparatus which comprises a jetting head, provided with a nozzle orifice, a pressure chamber communicated with the nozzle orifice, and a piezoelectric element which is deformable to cause pressure fluctuation to liquid contained in the pressure chamber, the method comprising the steps of:

generating simultaneously a plurality of drive signals, each provided with waveform elements including at least one drive pulse in every unit jetting cycle, the drive pulse deforming the piezoelectric element to cause such pressure fluctuation as to eject a liquid droplet from the nozzle orifice;

providing a switcher which selectively supplies at least one of the waveform elements included in one of the drive signals to the piezoelectric element; and controlling a selective supply operation of the switcher in accordance with amount data which indicates an amount of the liquid droplet to be ejected, wherein a time period in which the drive pulse is generated in one of the drive signal and that in another one of the drive signals overlap at least partly.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Preferred embodiments of the invention will be described hereinbelow by reference to the accompanying drawings. The following explanations are for an ink jet recording apparatus which one kind of a liquid jetting apparatus. The ink jet recording apparatus jets ink droplets which is one kind of liquid droplets of the invention.

Figure 1:
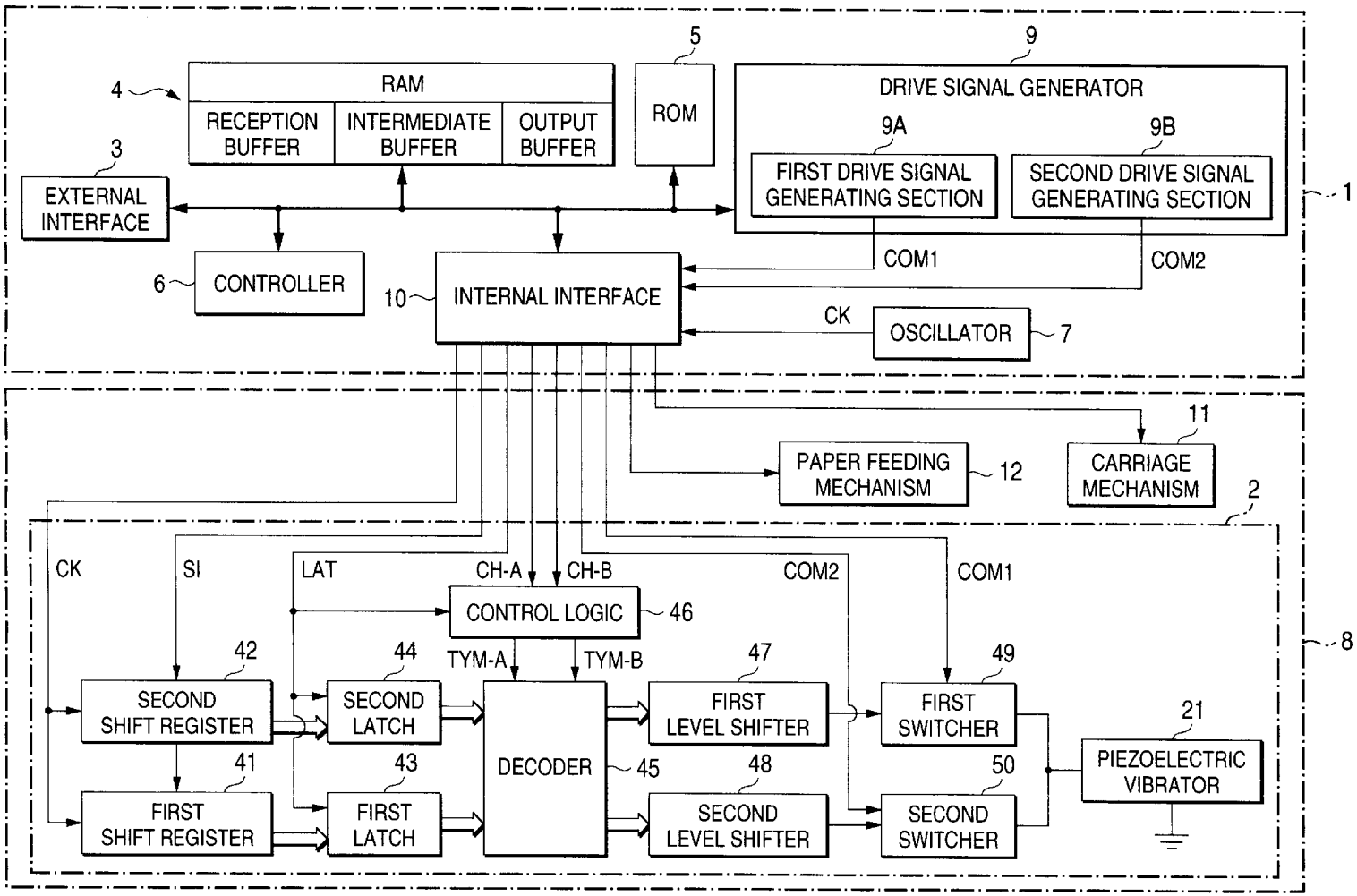
FIG. 1 is a functional block diagram showing an ink jet recording apparatus according to a first embodiment of the invention.

FIG. 1 shows a printer serving as an ink jet recording apparatus according to a first embodiment of the invention. The printer comprises a printer controller 1 and a print engine 2. The printer controller 1 has an external interface 3 for receiving print data or the like from an unillustrated host computer or the like; a RAM 4 for storing a variety of data sets; a ROM 5 for storing routines for use in processing a variety of data sets; a controller 6 provided as a CPU or the like; an oscillator 7 for generating a clock (CK) signal; a drive signal generator 9 for generating drive signals (COM1, COM2) to be supplied to a recording head; and an internal interface 10 for transmitting recording data, drive signals, or the like to the print engine 2.

The external interface 3 receives, from a host computer, print data consisting of one type of data or a plurality of types of data selected from, e.g., a character code, a graphic function, and image data. The external interface 3 outputs a busy (BUSY) signal and an acknowledgement (ACK) signal to the host computer.

The RAM 4 is utilized as a receiving buffer, an intermediate buffer, an output buffer, work memory (not shown), and the like. Print data that have been output from the host computer and received by the external interface 3 are temporarily stored in a receiving buffer. Intermediate code data that have been converted into an intermediate code by the controller 6 are stored in an intermediate buffer. Data to be recorded (hereinafter called "recording data") are expanded into an output buffer. The ROM5 stores various control routines, font data, graphics functions, and various procedures.

Figure 3:
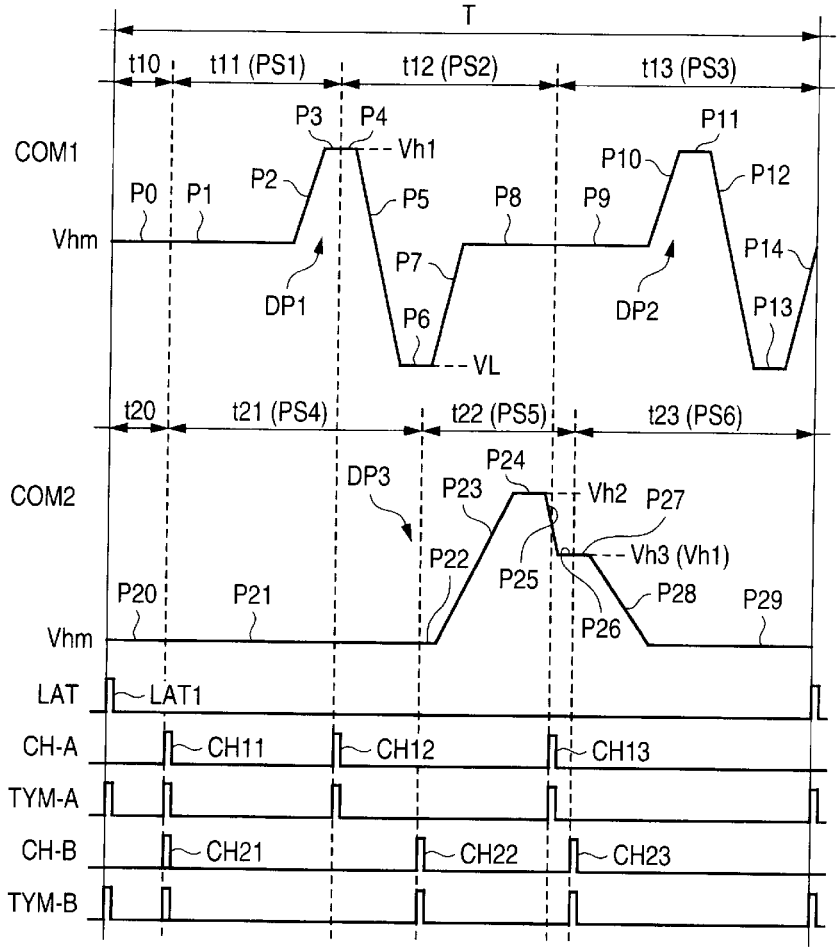
FIG. 3 is a diagram for describing a drive signal to be generated by a drive signal generator and supply control of the drive signal.
Figure 4:
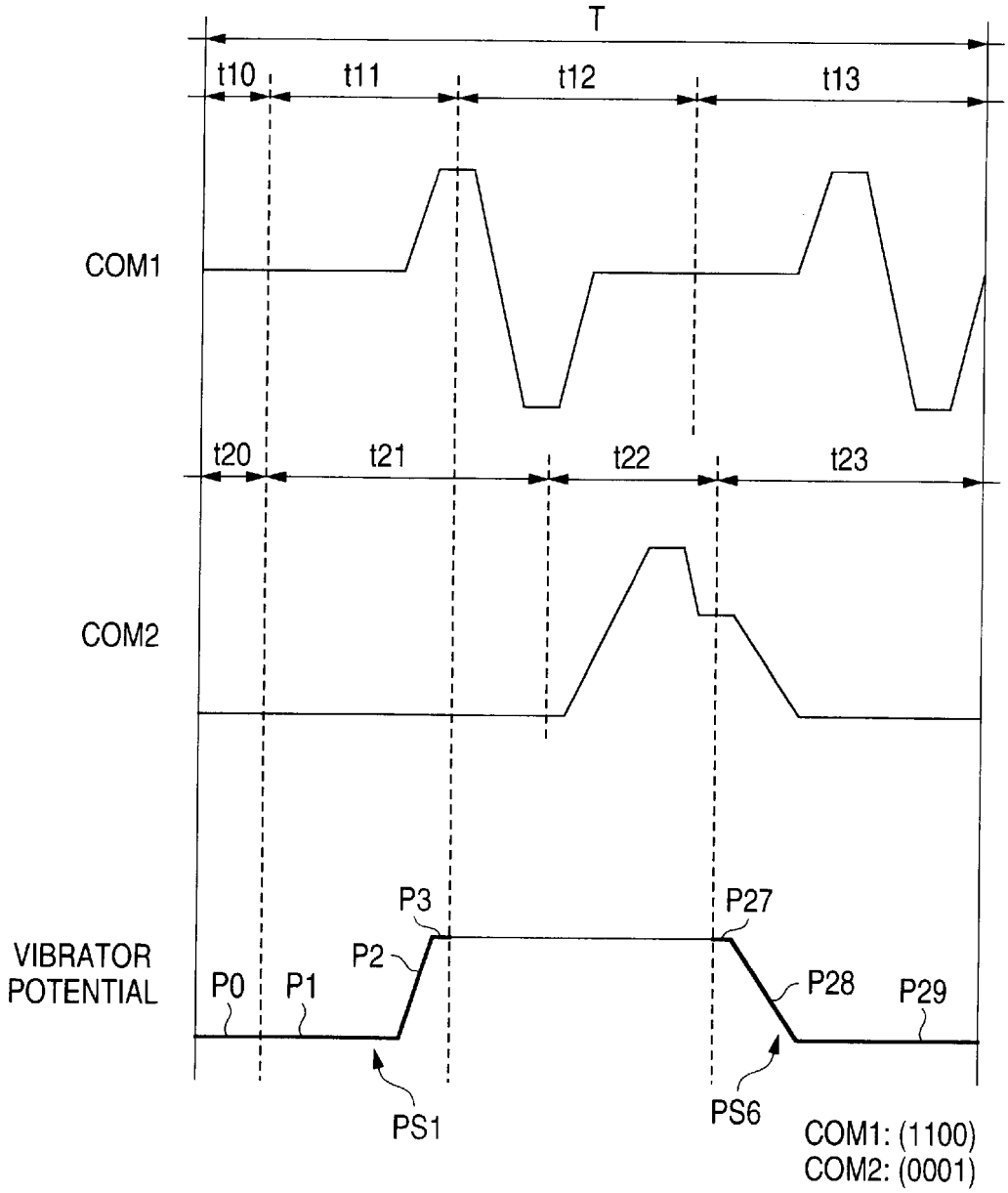
FIG. 4 is a diagram for describing control of supply of the drive signal during non-recording operation.

The drive signal generator 9 comprises a first drive signal generating section 9A capable of generating a first drive signal COM1 and a second drive signal generating section 9B capable of generating a second drive signal COM2. As shown in FIG. 3, the first drive signal COM1 is a signal train which includes two middle dot drive pulses DP1, DP2 within one recording cycle T and is generated at every recording cycle T. The second drive signal COM2 is a signal train which includes a small-dot drive pulse DP3 within one recording cycle T and is generated at every recording cycle T. The second rive signal COM2 is repeatedly generated at every recording cycle T. The drive signals COM1, COM2 will be described in detail later.

The controller 6 controls generation of a signal to be sent to the drive signal generator 9 and converts the print data output from the host computer into recording data. At the time of conversion of print data into recording data, the controller 6 reads print data from the inside of the receiving buffer, converts the thus-read print data into an intermediate code, and stores intermediate code data into an intermediate buffer. Next, the controller 6 analyzes the intermediate code data read from the intermediate buffer and converts the intermediate code data into recording data on a per-dot basis by reference to the font data and the graphics functions stored in the ROM5.

The recording data of the embodiment is constituted such that one bit is formed from two-bit gradation data. The gradation data comprise gradation data [00] indicating a non-recording state (meniscus vibrating operation); gradation data [01] indicating recording to be performed through use of small dots; gradation data [10] indicating recording to be performed through use of middle dots; and gradation data [11] indicating recording to be performed through use of large dots. Accordingly, such a data structure enables recording of each dot in four levels of tone.

The controller 6 constitutes a part of a timing signal generator and supplies a latch (LAT) signal and channel (CH-A, CH-B) signals to the recording head 8 by way of the internal interface 10. Latch pulses included in the latch signal and channel pulses included in the channel signals define start timings of supply of a plurality of waveform elements constituting the drive signals COM1, COM2 and supply of adjustment elements (PS1 to PS6, and P0, P20).

Specifically, as shown in FIG. 3, a latch pulse LAT1 defines a start timing of supply of an adjustment element P0 to be generated during a charging period t10 and a start timing of supply of an adjustment element P20 to be generated during a charging period t20.

A first channel pulse CH11 appearing in a first channel signal CH-A defines a start timing of supply of a first waveform section PS1 to be generated during a period t11 of the first drive signal COM1. A second channel pulse CH12 defines a start timing of supply of a second waveform section PS2 to be generated during a period t12. A third channel pulse CH13 defines a start timing of supply of a third waveform section PS3 to be generated during a period t13.

Similarly, a first channel pulse CH21 appearing in a second channel signal CH-B defines a start timing of supply of a fourth waveform section PS4 to be generated during a period t21 of the second drive signal COM2. A second channel pulse CH22 defines a start timing of supply of a fifth waveform section PS5 to be generated during a period t22. A third channel pulse CH23 defines a start timing of supply of a sixth waveform section PS6 to be generated during a period t23.

The print engine 2 will now be described. As shown in FIG. 1, the print engine 2 has a recording head 8, a carriage mechanism 11, and a paper feeding mechanism 12.

The carriage mechanism 11 is constituted of a carriage having the recording head 8 mounted thereon, and a drive motor (e.g., a DC motor) which causes to the carriage to travel by way of a timing belt or the like. The carriage mechanism 11 moves the recording head 8 in the primary scanning direction. The paper feeding mechanism 12 is constituted of a paper feeding motor and a paper feeding roller and like rollers. The paper feeding mechanism 12 performs secondary scanning by sequentially feeding recording paper (i.e., a kind of print recording medium).

Figure 2:
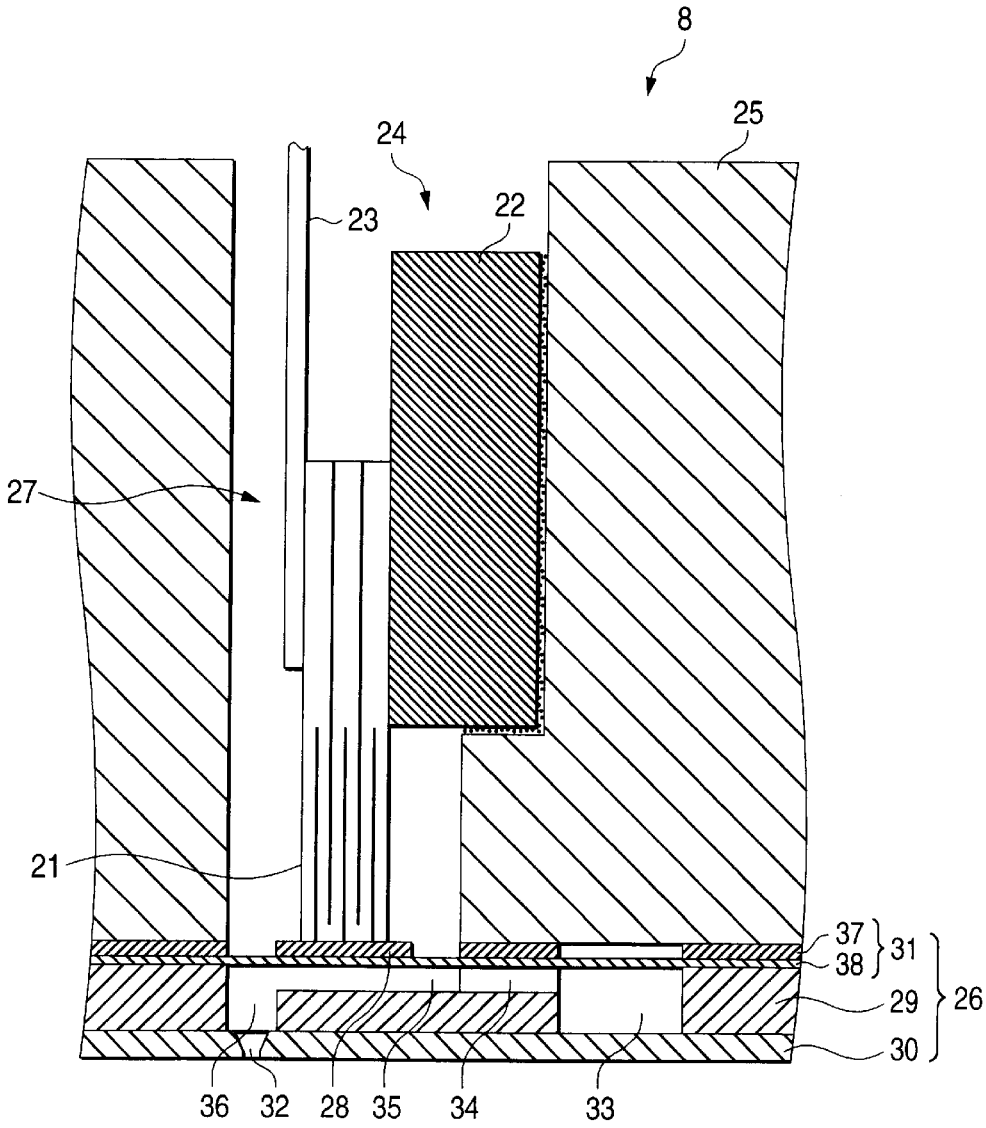
FIG. 2 is a cross-sectional view showing the configuration of a recording head of longitudinal vibration mode.

The recording head 8 will now be described in detail. First, the structure of the recording head 8 will be described by reference to FIG. 2. The illustrated recording head 8 has a vibrator unit 24 into which a plurality of piezoelectric vibrators 21 a fixation plate 22, and a flexible cable 23 are assembled as a unit; a case 25 capable of housing the vibrator unit 24; and a channel unit 26 joined to a leading end face of the case 25.

The case 25 is a block-shaped member which is formed from synthetic resin and defines a housing space 27 whose front and rear ends are open. The vibrator unit 24 is housed and fixed in the housing space 27.

The piezoelectric vibrator 21 is a kind of pressure generating element and formed into a longitudinally-elongated comb shape. The piezoelectric vibrator 21 is a piezoelectric vibrator of lamination type formed by laminating piezoelectric material layers and internal electrodes one on top of the other. The piezoelectric vibrator 21 is of longitudinal vibration mode, in which the vibrator can swell and shrink in a longitudinal direction orthogonal to the direction in which the piezoelectric material layers are laminated. Leading-end faces of the respective piezoelectric vibrators 21 are joined to an island portion 28 of the channel unit 26.

The piezoelectric vibrator unit 21 acts in the same way as does a capacitor. Specifically, when supply of a signal is stopped, the potential of the piezoelectric vibrator 21 (i.e., the potential of the vibrator) is held at a potential attained immediately before supply of the signal is stopped.

The channel unit 26 is constituted by sandwiching a channel forming substrate 29 between a nozzle plate 30 and an elastic plate 31, which oppose each other.

The nozzle plate 30 is formed from a thin metal plate material (e.g., a stainless steel plate) having a plurality of nozzle orifices 32 (e.g., 96 nozzle orifices) provided in a secondary scanning direction. The channel forming substrate 29 is a plate-shaped member in which an ink flow passage is defined by a common ink reservoir 33, an ink supply port 34, a pressure chamber 35, and a communication port 36. In the embodiment, the, channel forming substrate 29 is made of a silicon wafer by etching. The elastic plate 31 is a composite plate material of a dual structure and formed by laminating a stainless steel support plate 37 with a resin film 38. The island portion 28 is formed by annually removing a portion of the support plate 37 opposing the pressure chamber 35.

In the recording head 8, a string of ink flow passages are defined for each nozzle orifice 32 so as to extend from the common ink reservoir 33 to a corresponding nozzle orifice 32 by way of the pressure chamber 35. The piezoelectric vibrator 21 is deformed as a result of being subjected to discharging and charging. Specifically, the piezoelectric vibrator 21 of longitudinal vibration mode contracts in a longitudinal direction thereof when subjected to recharge and extends in the same direction when subjected to discharge. When the potential of the vibrator is increased as a result of a charging operation, the island portion 28 is pulled toward the piezoelectric vibrator, whereby the resin film 38 located around the island portion 28 is deformed and the pressure chamber 35 expands. In contrast, when the potential of the vibrator is lowered as a result of a discharging operation, the pressure chamber 35 contracts.

In this way, the volume of the pressure chamber 35 can be controlled in accordance with the potential of the vibrator, and hence the pressure of the ink stored in the pressure chamber 35 can be changed, thereby ejecting an ink droplet from the nozzle orifice 32. For instance, the pressure chamber 35 having a reference volume is caused to abruptly shrink after having been expanded, thereby enabling ejection of an ink droplet.

An electrical configuration of the recording head 8 will now be described.

As shown in FIG. 1, the recording head 8 has a shift register circuit constituted of a first shift register 41 and a second shift register 42; a latch circuit constituted of a first latch 43 and a second latch 44; a level shifter circuit constituted of a decoder 45, a control logic 46, a first level shifter 47, and a second level shifter 48; a switching circuit constituted of a first switcher 49 and a second switcher 50; and the piezoelectric vibrators 21.

A plurality of shift registers 41, 42; a plurality of latches 43, 44; a plurality of level shifters 47, 48; a plurality of switchers 49, 50; and a plurality of piezoelectric vibrators 21 are provided so as to correspond to the respective nozzle orifices 32.

In accordance with the recording data (SI) output from the printer controller 1, the recording head 8 ejects ink droplets. In the embodiment, a group of higher order bits of recording data and a group of lower order bits of recording data are sent to the recording head 8, in this sequence. Hence, the group of higher order bits of recording data are first set in the second shift register 42. When the group of higher order bits of recording data have been set in the second shift register 42 with regard to all the nozzle orifices 32, the group of lower order bits of recording data are subsequently set in the second shift register 42. In association with setting of the group of lower order bits of recording data, the group of higher order bits of recording data are shifted and set to the first shift register 41.

The first latch 43 is electrically connected to the first shift register 41. The second latch 44 is electrically connected to the second shift register 42. When a latch pulse (LAT1) output from the printer controller 1 is input to the respective latch circuits 43, 44, the first latch 43 latches the group of higher order bits of recording data, and the second latch 44 latches the group of lower order bits of recording data.

The recording data (i.e., the group of higher order bits and the group of lower order bits) latched by the latch circuits 43, 44 are respectively input to the decoder 45 The decoder 45 performs translating operation on the basis of the higher order bits and lower order bits of recording data, thereby producing waveform selection data to be used for selecting the waveform elements PS1 to PS6 and the adjustment elements P0, P20, which constitute the drive signals COM1, COM2.

In the embodiment, the waveform selection data are generated for each of the drive signals COM1, COM2. Specifically, first waveform selection data corresponding to the first drive signal COM1 are formed from a total of four bits of data; that is, the bits being assigned respectively to a first adjustment element P0 (a period t10), a first waveform section PS1 (a period t11), a second waveform section PS2 (a period t12), and a third waveform section PS3 (a period t13). Second waveform selection data corresponding to the second drive signal COM2 are formed from a total of four bits of data; that is, the bits being assigned respectively to a second adjustment element P20 (a period t20), a fourth waveform section P54 (a period t21), a fifth waveform section PS5 (a period t22), and a sixth waveform section PS6 (a period t23).

The decoder 45 serves as a waveform selection data generator and generates a plurality of sets of waveform selection data from the recording data (i.e., gradation data), the data being equal in number to drive signals.

A timing signal output from the control logic 46 is also input to the decoder 45. The control logic 46 serves as the timing signal generator along with the controller 6. In synchronism with input of a latch signal (LAT) and channel signals (CH-A, CH-B), timing signals (TYM-A, TYM-B) are generated.

The timing signal is also generated for each of the drive signals COM1, COM2. Specifically, the control logic 46 generates the first timing signal (TYM-A) from the latch pulse (LAT1) and channel pulses (CH11 to CH13) for the first drive signal COM1. Further, the control logic 46 generates the second timing signal (TYM-B) from the latch pulse and channel pulses (CH21 to CH23) for the second drive signal COM2.

The four bits of waveform selection data generated by the decoder 45 are input to the respective level shifters 47, 48 in descending order from the high order bits at a timing specified by the timing signal. In accordance with timings at which respective timing pulses included in the first timing signal TYM-A are to be generated, the first waveform selection data are input to the first level shifter 47. Moreover, in accordance with timings at which respective timing pulses included in the second timing signal TYM-B are to be generated, the second waveform selection data are input to the second level shifter 48.

The level shifters 47, 48 serves as voltage amplifiers. In a case where the waveform selection data assume a value of [1], the level shifters 47, 48 output an electric signal which has been boosted up to a voltage at which corresponding switchers 49, 50 can be activated; for example, approximately tens of volts. More specifically, when the first waveform selection data assume a value of [1], an electric signal is output to the first switcher 49. When the second waveform selection data assume a value of [1], an electric signal is output to the second switcher 50.

The first drive signal COM1 is supplied to an input side of the first switcher 49 from the drive signal generator 9. The second drive signal COM2 is supplied to an input side of the second switcher 50 from the same. Further, the piezoelectric vibrator 21 is electrically connected to output sides of the switchers 49, 50. The switchers 49, 50 are provided in accordance with the type of a drive signal to be generated. The switchers 49, 50 are interposed between the drive signal generator 9 and the piezoelectric vibrator 21 and selectively supply the drive signals COM1, COM2 to the piezoelectric vibrator 21.

The waveform selection data are used to control operation of the switcher 49 and that of the switcher 50. During a period in which the waveform selection data input to the first switcher 49 assumes a value of [1], the first switcher 49 is brought into conduction, and the first drive signal COM1 is supplied to the piezoelectric vibrator 21. Similarly, during a period in which the waveform selection data input to the second switcher 50 assumes a value of [1], the second switcher 50 is brought into conduction, and the first drive signal COM1 is supplied to the piezoelectric vibrator 21. In response to the thus-supplied drive signals COM1, COM2, a potential of the piezoelectric vibrator 21 is changed. During a period in which the waveform selection data input to the switcher 49 and those input to the switcher 50 assume a value of [0 ], an electric signal to be used for activating the switchers 49, 50 is output from neither the level shifter 47 nor the level shifter 48. Hence, a drive signal is not supplied to the piezoelectric vibrator 21. In other words, the adjustment elements P0, P20 and the waveform elements (i.e., the first waveform section PS1 through the sixth waveform section PS6), which have arisen during a period in which a value of [1] is set as waveform selection data, are selectively supplied to the piezoelectric vibrator 21.

In the embodiment, the decoder 45, the control logic 46, and the level shifters 47, 48 serve as a switch controller. The switchers 49, 50 are controlled in accordance with recording data (i.e., gradation data).

The drive signals COM1, COM2 generated by the drive signal generator 9 will now be described, along with control of supply of the drive signals COM1, COM2 to the piezoelectric vibrator 21.

As mentioned above, the drive signals shown in FIG. 3 are embodied as the first drive signal COM1 and the second drive signal COM2. The first drive signal COM1 comprises a first adjustment element P0 generated during the period t10; a first waveform section PS1 generated during the period t11; a second waveform section PS2 generated during the period t12; and a third waveform section PS3 generated during the period t13. The second drive signal COM2 comprises a second adjustment element P20 generated during the period t20; a fourth waveform section PS4 generated during the period t21; a fifth waveform section PS5 generated during the period t22; and a sixth waveform section PS6 generated during the period t23.

The first drive signal COM1 will first be described.

The first adjustment element P0 is formed from a waveform element which is uniform at an intermediate potential Vhm. As will be described later, the first adjustment element P0 is supplied to the piezoelectric vibrator 21 so as to adjust the potential of the vibrator to the intermediate potential Vhm at the beginning of the recording cycle T.

Here, the intermediate potential Vhm is a kind of reference potential and also serves as leading-edge and trailing-edge potentials of the respective drive pulses DP1 through PD3.

The first waveform section PS1 is formed from a first constant potential element P1, a first expanding element P2, and a first expansion holding element P3. The first constant potential element P1 is a waveform element which is constant at an intermediate potential Vhm. The first expanding element P2 is a waveform element for causing a potential to increase from the intermediate potential Vhm to a first expansion potential Vh1 at such a relatively gentle-constant gradient that no ink droplets are ejected. The first expansion holding element P3 is a waveform element which is constant at the first expansion potential Vh1.

The second waveform section PS2 is formed from a second expansion holding element P4, a first ejection element P6, a contraction holding element P6, a damping element P7, and a second constant potential element P8. The second expansion holding element P4 is a waveform element which is constant at the first expansion potential Vh1. The first ejection element P5 is a waveform element for causing a potential to drop from the first expansion potential Vh1 to a contraction potential VL at a relatively steep gradient. The contraction holding element P6 is a waveform element which is constant at the contraction potential VL. The damping element P7 is a waveform element for causing a potential to increase from the contraction potential VL to the intermediate potential Vhm at such a relatively gentle constant gradient that no ink droplets are ejected. Moreover, the second constant potential element P8 is a waveform element which is constant at the intermediate potential Vhm.

The third waveform section PS3 is formed from a third constant potential element P9, a first expanding element P10, an expansion holding element P11, a first ejection element P12, a contraction holding element P13, and a damping element P14.

The third constant potential element P9 is a waveform element which is constant at the intermediate potential Vhm. The expansion holding element P11 is a waveform element which is constant at the first expansion potential Vh1. A period of time during which the expansion holding element P11 is generated is set to a value equal to the sum of the duration of the first expansion holding element P3 and the duration of the second expansion holding element P4.

The remaining waveform elements; that is, the first expanding element P10, the first ejection element P12, the contraction holding element P13, and the damping element P14, are identical with the first expanding element P2, the first ejection element P5, the contraction holding element P6, and the damping element P7, all belonging to the first and second waveform elements PS1, PS2, and hence their repeated explanations are omitted.

In relation to the first drive signal COM1, the first expanding element P2, the first expansion holding element P3, the second expansion holding element P4, the first ejection element P5, the contraction holding element P6, and the damping element P7, all belonging to the first and second waveform elements PS1, PS2, constitute the first middle dot drive pulse DP1. Moreover, the first expanding element P10, the expansion holding element P11, the first ejection element P12, the contraction holding element P13, and the damping element P14, all belonging to the third waveform section PS3, constitute the second middle dot drive pulse DP2. The middle dot drive pulses DP1, DP2 assume identical waveform patterns. When the middle dot drive pulses DP1, DP2 are supplied to the piezoelectric vibrator 21, the amount of ink corresponding to a middle dot is ejected from a corresponding nozzle orifice 32.

Descriptions are now given by taking the first middle dot drive pulse DP1 as an example. As a result of supply of the first expanding element P2, the piezoelectric vibrator 21 contracts in a longitudinal direction thereof. In contract, a corresponding pressure chamber 35 expands from a reference volume corresponding to the intermediate potential Vhm (reference potential) to an expanded volume corresponding to a first expansion potential Vh1. By the expanding action of the pressure chamber 35, ink is supplied from the common ink reservoir 33 to the inside of the pressure chamber 35. The expanded state of the pressure chamber 35 is maintained during a period in which the first and second expansion holding elements P3 and P4 are supplied.

Subsequently, the first ejection element P5 is supplied to the piezoelectric vibrator 21, whereby the piezoelectric vibrator 21 is extended. In association with extension of the piezoelectric vibrator 21, the pressure chamber 35 is abruptly contracted from the expanded volume to a contracted volume corresponding to the contraction potential VL. The ink stored in the pressure chamber 35 is compressed as a result of abrupt contraction of the pressure chamber 35, whereby a predetermined quantity of ink is ejected from a corresponding nozzle orifice 32.

The contracted state of the pressure chamber 35 is maintained over a period during which the contraction holding element P6 is supplied. During this period, the pressure of the ink stored in the pressure chamber 35, the pressure having dropped by ejection of an ink droplet, is again increased by the natural vibration of ink. The damping element P7 is supplied in step with the timing at which the pressure increases. As a result of supply of the damping element P7, the pressure chamber 35 expands and is restored to the reference volume, thereby absorbing changes in the pressure of the ink stored in the pressure chamber 35.

In relation to the first drive signal COM1, the first middle dot drive pulse DP1 and the second middle dot drive pulse DP2 are connected together at the leading edge and trailing-edge potentials thereof (i.e., the intermediate potential Vhm), by the first adjustment element P0, the first constant potential element P1, the second constant potential element P8, and the third constant potential element P9. Thus, the middle dot drive pulses DP1, DP2 are generated at given intervals over adjacent recording cycles T. Specifically, the sum of a period of time during which the first adjustment element P0 is generated and a period of time during which the first constant potential element P1 is generated is set to a value identical with that of the sum of a period of time during which the second constant potential element P8 is generated and a period of time during which the third constant potential element P9 is generated.

Given that the middle dot drive pulses DP1, DP2 are generated at given intervals over adjacent recording cycles T, when the medium drive pulses DP1, DP2 are continuously supplied to the piezoelectric vibrator 21, the status of a meniscus achieved at the beginning of supply of the drive pulses can be maintained constant. As a result, the flight of an ink droplet can be stabilized, thereby realizing an attempt to improve image quality.

In relation to the first drive signal COM1 having the foregoing configuration, the first expanding elements P2, P10, the first expansion holding element P3, the second expansion holding element P4, the expansion holding element P11, the first ejection elements P5, P12, the contraction holding elements P6, P13, and the damping elements P7, P14, serve as drive waveform elements.

On the other hand, the first adjustment element P0, the first constant potential element P1, the second constant potential element P8, and the third constant potential element P9, serve as constant-potential waveform elements.

The second drive signal COM2 will now be described.

The second adjustment element P20 is formed from a waveform element which is constant at the intermediate voltage Vhm, in the same manner as is the first adjustment element P0. In order to adjust the potential of the vibrator to the intermediate potential Vhm at the beginning of the recording cycle T, the second adjustment element P20 is also supplied to the piezoelectric vibrator 21.

In the embodiment, either the second adjustment element P20 or the first adjustment element P0 is supplied to the piezoelectric vibrator 21 at the beginning of the recording cycle T. Hence, a period t20 of time during which the second adjustment element P20 is generated is set to become identical in duration with a period t10 of time during which the first adjustment element P0 is generated.

The fourth waveform section PS4 is formed from a fourth constant potential element P21. The fourth potential element P21 is a waveform element which is constant at the intermediate potential Vhm and is generated at a point in time between the period t11 and the period t12 of the first drive signal COM1. Specifically, generation of the waveform element is commenced at the start of the period t11 and terminated at an intermediate point during a period of time in which the contraction holding element P6 of the second waveform section PS2 is generated.

The fifth waveform section PS5 is formed from a fifth constant potential element P22, a second expanding element P23, an expansion holding element P24, a second ejection element P25, and a first contraction holding element P26. The fifth potential element P22 is a waveform element which is constant at the intermediate potential Vhm and is generated over an extremely short period of time. The second expanding element P23 is a waveform element which causes a potential to abruptly increase from the intermediate potential Vhm to a second expansion potential Vh2. The expansion holding element P24 is a waveform element which is constant at the second expansion potential Vh2. The second ejection element P25 is a waveform element which causes a potential to abruptly drop from the second expansion potential Vh2 to an ejection potential Vh3. The first contraction holding element P26 is a waveform element which is constant at the ejection potential Vh3.

The ejection potential Vh3 of the embodiment is made equal to the first expansion potential Vh1 of the first drive signal COM1.

The sixth waveform section PS6 is formed from a second contraction holding element P27, a damping element P28, and a sixth constant potential element P29. The second contraction holding element P27 is a waveform element which is constant at the ejection potential Vh3 and is generated over an extremely short period of time. The damping element P28 is a waveform element for causing a potential to drop from the ejection potential Vh3 to the intermediate potential Vhm at a relatively gentle, constant gradient. The sixth constant potential element P29 is a waveform element which is constant at the intermediate potential Vhm and is generated from the trailing edge of the damping element P28 to the trailing edge of the recording cycle T.

In relation to the second drive signal COM2, the second expanding element P23, the expansion holding element P24, the second ejection element P25, the contraction holding elements P26, P27, and the damping element P28, all belonging to the fifth and sixth waveform elements PS5, PS6, constitute the small dot drive pulse DP3 When the small dot drive pulse DP3 is supplied to the piezoelectric vibrator 21, a nominal amount of ink corresponding to a small dot is ejected from the nozzle orifice 32.

Specifically, as a result of supply of the second expanding element P23, the piezoelectric vibrator 21 rapidly contracts in the longitudinal direction thereof. The pressure chamber 35 rapidly expands from the reference volume corresponding to the intermediate potential Vhm to an expanded volume corresponding to the second expansion potential Vh2. As a result of expansion, relatively high negative pressure develops in the pressure chamber 35, thereby strongly drawing a meniscus (i.e., an exposed free surface of ink in the nozzle orifice 32) toward the pressure chamber 35. The expanded state of the pressure chamber 35 is held over a period during which the expansion holding element P24 is supplied. During this period, the moving direction of a center portion of the meniscus is reversed to the direction in which ink is to be ejected. The center portion becomes raised in the form of a pillar.

Subsequently, the second ejection element P25 is supplied to the piezoelectric vibrator 21, whereupon the vibrator extends. As a result of extension of the piezoelectric vibrator 21, the pressure chamber 35 is abruptly contracted from the expanded volume to an ejection volume corresponding to the second expansion potential Vh3. By abrupt contraction of the pressure chamber 35, the ink stored in the pressure chamber 35 is compressed, thereby promoting growth of the pillar portion. The pillar portion is broken at an intermediate position thereof, whereby ink is ejected in the form of an ink droplet.

The second ejection element P25 is followed by supply of the first contraction holding element P26 and supply of the second contraction holding element P27 Subsequently, the damping element P28 is supplied. The damping element P28 contracts the pressure chamber 35 so as to compensate for the drop in pressure of the ink stored in the pressure chamber 35 resulting from ejection of an ink droplet. Specifically, the pressure chamber 35 is contracted to a reference volume by supply of the damping element P28, thereby absorbing a change in the pressure of the ink stored in the pressure chamber 35.

A period of time during which the respective waveform elements (P23 through P28) constituting the small dot drive pulse DP3 are to be generated partially overlaps periods of time during which the respective waveform elements (P2 to P7, P10 to P14) constituting the middle dot drive pulse DP1, DP2 are to be generated. Specifically, a period of time during which the second expanding element P23 of the small dot drive pulse DP3 is generated partially overlaps a period of time during which the damping element P7 of the first middle dot drive pulse DP1 is to be generated. Further, a period of time during which the damping element P28 of the small dot drive pulse DP3 is to be generated overlaps, at the trailing edge, a period of time during which the first expanding element P10 of the second middle dot drive pulse DP2 is to be generated.

In this way, the drive pulses DP1 to DP3 are divided into the drive signals COM1, COM2 and generated so as to be superimposed on each other with respect to time. In this case, the drive pulses DP1 through DP3 and the first vibrating pulse VP1 can be efficiently arranged in even a recording cycle T of limited length. Consequently, high-frequency driving of the recording head 8 can be realized.

In relation to the second drive signal COM2, the small dot drive pulses DP3 are connected together at the leading-edge and trailing-edge potentials thereof (i.e., the intermediate potential Vhm), by the second adjustment element P20, the fourth constant potential element P21, the fifth constant potential element P22, and the sixth constant potential element P29.

A timing at which the small dot drive pulse DP3 is to be generated is set to an intermediate point in time between the first middle dot drive pulse DP1 and the second middle dot drive pulse DP2. In detail, a timing at which the second ejection element P25 of the small middle dot drive pulse DP3 is to be generated is set to an exactly intermediate point in time between a timing at which the first ejection element P5 of the first middle dot drive pulse DP1 is to be generated and a timing at which the first ejection element P12 of the second middle dot drive pulse DP2 is to be generated, in an attempt to improve image quality.

As will be described later, in the embodiment, the first middle dot drive pulse DP1 and the second middle dot drive pulse DP2 are supplied to the piezoelectric vibrator 21 at the time of recording of a large dot, and the second middle dot drive pulse DP2 is supplied to the piezoelectric vibrator 21 at the time of recording of a middle dot. Further, at the time of recording of a small dot, the small dot drive pulse DP3 is supplied to the piezoelectric vibrator 21.

Here, if the small dot drive pulse DP3 is generated at an intermediate point in time between the first middle dot drive pulse DP1 and the second middle dot drive pulse DP2, an interval between ejection of an ink droplet and ejection of the next ink droplet can be made uniform even when a recording gradation is changed between a preceding recording cycle T and a current recording cycle T. For instance, an interval between ejection of ink for producing a small dot during a preceding recording cycle T and ejection of ink for producing a large dot during a current recording cycle T can be made equal to that existing between ejection of ink for producing a large dot during a preceding recording cycle T and ejection of ink for producing a small dot during the current recording cycle T.

As a result, the status of a meniscus generated during a current recording cycle T becomes uniform, and ejection of an ink droplet can stabilized, and by extension image quality can be improved.

In relation to the second drive signal COM2 having the foregoing configuration, the second expanding element P23, the expansion holding element P24, the second ejection element P25, the first contraction holding element P26, the second contraction holding element P27, and the shrinking damping element P28, serve as drive waveform elements. On the other hand, the second adjustment element P20, the fourth constant potential element P21, the fifth constant, potential element P22, and the sixth constant potential element P29, serve as constant-potential waveform elements.

Control of multiple gradations to be performed in the embodiment will now be described by reference to FIGS. 3 through 7. During control of multiple gradations, the switchers 49, 50 are controlled by the switch controller (embodied by a combination of the decoder 45, the control logic 46, and the level shifters 47, 48; the same also applies to any counterparts in the following descriptions). The respective switchers 49, 50 supply the selected drive signals COM1, COM2 to the piezoelectric vibrator 21. Specifically, the first drive signal COM1 and the second drive signal COM2 are not simultaneously supplied to the piezoelectric vibrator 21, in order to stabilize the potential of the vibrator 21.

An explanation will first be given of the case of non-recording operation (meniscus vibration). In this case, the decoder 45 generates the first waveform selection data [1100] and the second waveform selection data [0001] by translation of gradation data [00] for non-recording operation. The switch controller controls operation of the first switcher 49 and that of the second switcher 50 on the basis of the thus-generated waveform selection data, which in turn controls supply of the first drive signal COM1 and the second drive signal COM2 to the piezoelectric vibrator 21.

During the period t10 (t20), the first adjustment element P10 is supplied to the piezoelectric vibrator 21. As a result, the potential of the vibrator is adjusted to the intermediate potential Vhm. Here, one is selected from the first adjustment element P0 and the second adjustment element P20 in accordance with the next waveform element (i.e., waveform element) to be sent, and the selected element is supplied to the piezoelectric vibrator 21. Specifically, if the next waveform element to be supplied is a waveform element of the first drive signal COM1, the fist adjustment element P0 is selected. If the next waveform element to be supplied is a waveform element of the second drive signal COM2, the second adjustment element P20 is selected. Such a selecting operation is performed in order to reduce the number of times the switchers 49, 50 operate. More specifically, if the number of times the switchers 49, 50 operate is reduced, a drive signal supplied to the piezoelectric vibrator 21 is stabilized, in turn stabilizing operation of the piezoelectric vibrator 21.

During the period t11, the first switcher 49 is brought into a connected state. During the period t21, the second switcher 50 is brought into a disconnected state. Specifically, as indicated by a bold line shown in FIG. 4, the first waveform section PS1 of the first drive signal COM1 is supplied to the piezoelectric vibrator 21. The pressure chamber 35 is expanded to an expanded volume by the first expanding element P2. In association with swelling of the pressure chamber 35, the ink stored in the pressure chamber 35 is slightly decompressed.

During subsequent periods t12 and t13, the first switcher 49 is controlled and brought into a disconnected state, and the second switcher 50 is controlled and brought into a disconnected state during a period t22. As a result, neither the first drive signal COM1 nor the second drive signal COM2 is supplied to the piezoelectric vibrator 21 from the beginning of the period t12 to the end of the period t22. Consequently, as indicated by a semi-bold line shown in FIG. 4, the potential of the vibrator is maintained at the first expansion potential Vh1 which appears immediately before disconnection of the first switch, and the expanded volume of the pressure chamber 35 is maintained. During the period, pressure fluctuations in the ink stored in the pressure chamber 35 are induced by the depressurization that has arisen during the period t11.

During a period t23, the second switcher 50 is controlled and brought into a connected state. As a result, as indicated by a bold line shown in FIG. 4, a sixth waveform section PS6 of the second drive signal COM2 is supplied to the piezoelectric vibrator 21, whereby the pressure chamber 35 is contracted to the reference volume by the damping element P28. In association with contraction of the pressure chamber 35, the ink stored in the pressure chamber 35 is slightly compressed.

By pressure fluctuations imparted to ink, a meniscus is minutely vibrated toward the pressure chamber 35 as well as in a direction in which an ink droplet is to be ejected. By the minute vibration of the meniscus, the ink that is located in the vicinity of the nozzle orifice 32 and whose viscosity is increased is dispersed, thereby preventing an increase in the viscosity of ink.

In the embodiment, the first expansion potential Vh1 of the first drive signal COM1 and the ejection potential Vh2 of the second drive signal COM2 are set so as to assume the same potential. Hence, when the sixth waveform section PS6 (i.e., a second contraction holding element P27) is supplied to the piezoelectric vibrator 21 during the period t23, the potential of the vibrator and the leading-edge potential of the sixth waveform section PS6 are made equal to each other. Hence, the sixth waveform section PS6 can be smoothly supplied to the piezoelectric vibrator 21.

In the embodiment, in the case of a recording gradation for non-recording, portions of the waveform elements constituting the first drive signal COM1 (i.e., the first expanding element P2 and the first expansion holding element P3) and a portion of the waveform element constituting the second drive signal COM2 (i.e., the second contraction holding element P27 and the damping element P28) are supplied, in combination, to the piezoelectric vibrator 21, thereby minutely vibrating a meniscus. As a result, the meniscus can be vibrated minutely without provision in the respective drive signals COM1, COM2 of the waveform elements specifically designed for minute vibration, thereby preventing an increase in the viscosity of the ink located in the vicinity of the nozzle orifice 32.

There, will now be described a case where recording is performed through use of small dots. In this case, the decoder 45 generates first waveform selection data [0000] and second waveform selection data [1111] by translation of gradation data [01] pertaining to small dots. The switch controller controls supply of the first and second drive signals COM1, COM2 to the piezoelectric vibrator 21 on the basis of the thus-generated waveform selection data.

Specifically, during the period t10 (t20), the second adjustment element P20 is supplied to the piezoelectric vibrator 21, whereby the potential of the vibrator is adjusted to the intermediate potential Vhm. During the periods t11 to t13, the first switcher 49 is controlled and brought into a disconnected state. During periods t21 to t23, the second switcher 50 is controlled and brought into a connected state.

As a result, the fourth waveform section PS4 is supplied to the piezoelectric vibrator 21 during the period t21; the fifth waveform section PS5 is supplied to the same during the period t22; and the sixth waveform section PS6 is supplied to the same during the period t23. More specifically, the small dot drive pulse DP3 is supplied to the piezoelectric vibrator 21.

Figure 5:
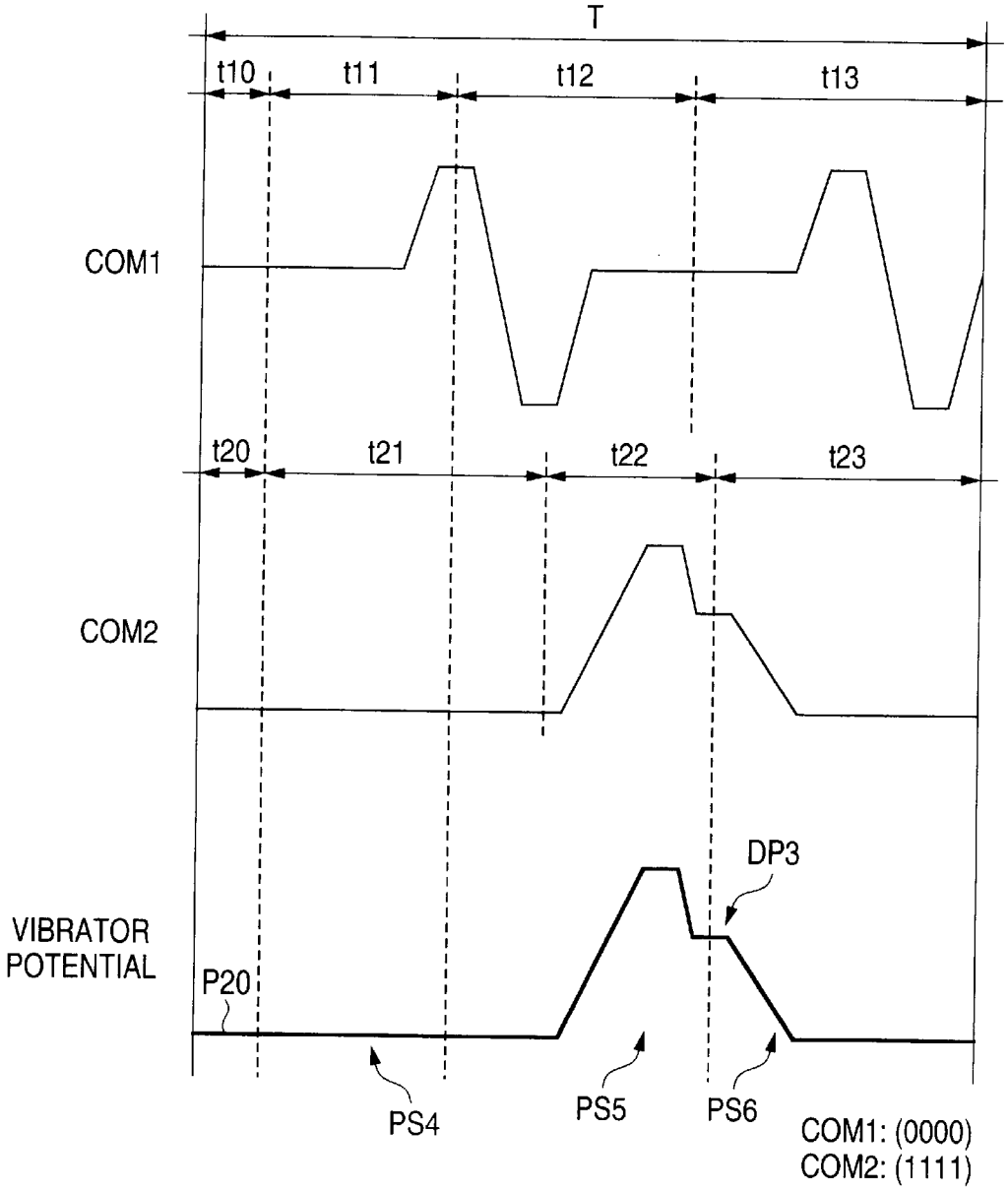
FIG. 5 is a diagram for describing control of supply of a drive signal at the time of small dot recording operation.
Figure 6:
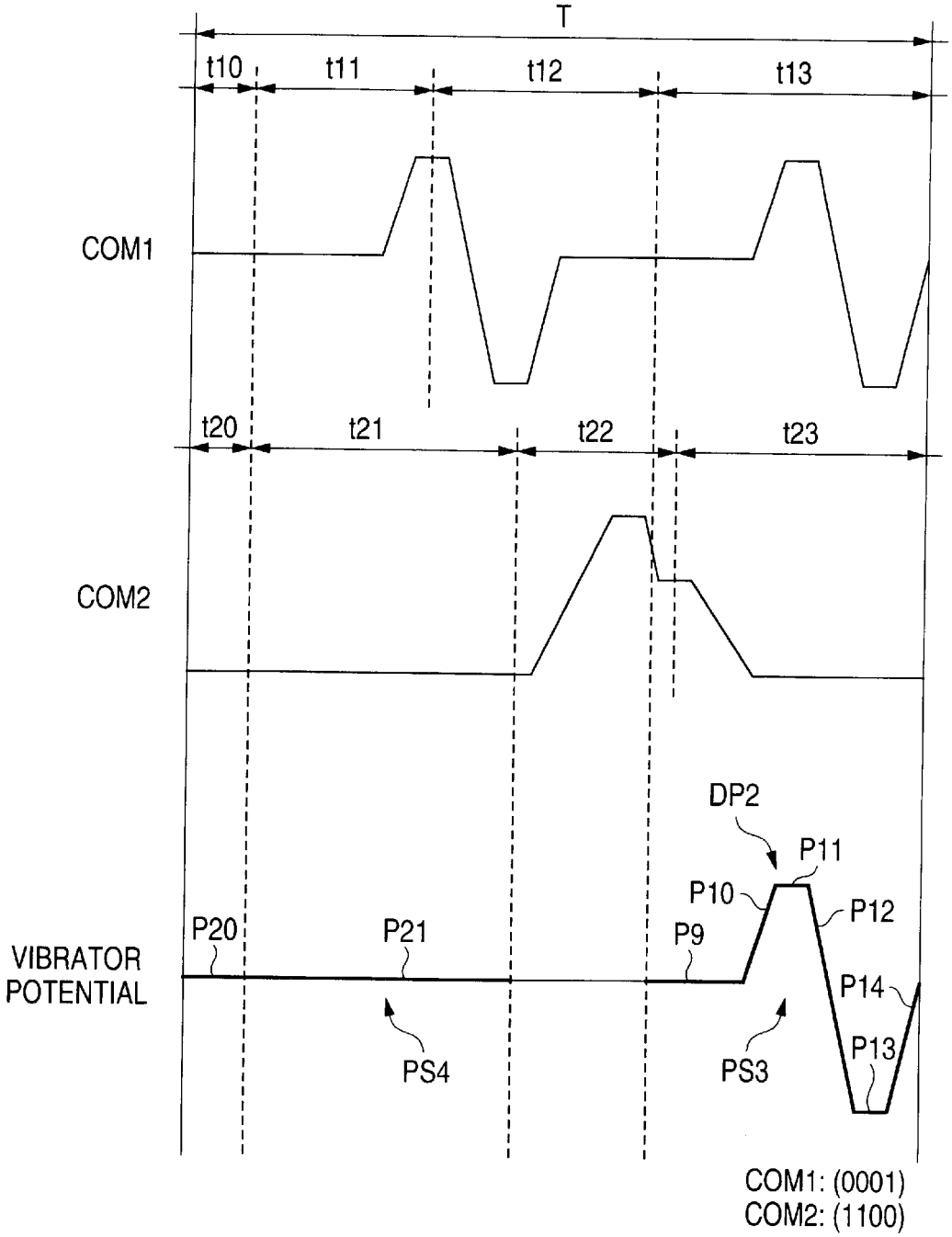
FIG. 6 is a diagram for describing control of supply of a drive signal at the time of middle dot recording operation.

Consequently, as indicated by a bold line shown in FIG. 5, the potential of the vibrator is changed in accordance with the second drive signal COM2, and a nominal amount of ink is ejected from the nozzle orifice 32 by the small dot drive pulse DP3.

There will now be described the case of recording of middle dots. In this case, the decoder 45 generates first waveform selection data [0001] and second waveform selection data [1100] by translation of gradation data [10] pertaining to middle dots. The switch controller controls supply of the first and second drive signals COM1, COM2 to the piezoelectric vibrator 21 on the basis of the thus-generated waveform selection data.

During the period t10 (t20), the first adjustment element P0 and the second adjustment element P20 are supplied to the piezoelectric vibrator 21, and the potential of the piezoelectric vibrator 21 is adjusted to the intermediate potential Vhm. During the periods t11 and t12, the first switcher 49 is brought into a disconnected state. During the period t21, the second switcher 50 is brought into a connected state. As indicated by a bold line shown in FIG. 6, the second waveform section PS4 of the second drive signal COM2 is supplied to the piezoelectric vibrator 21, and the potential of the vibrator is maintained at the intermediate potential Vhm by the fourth constant potential element P21.

During the subsequent period t22, the second switcher 50 is controlled and brought into a disconnected state. During a period from the beginning of the period t22 to the end of the period. t13, neither the first drive signal COM1 nor the second drive signal COM2 is supplied to the piezoelectric vibrator 21. Consequently, as indicated by a semi-bold line shown in FIG. 6, the potential of the vibrator is maintained at the intermediate potential Vhm which arises before disconnection of the switchers. Since the fourth constant potential element P21 has already been supplied to the piezoelectric vibrator 21 during the preceding period t21, the period of time during which the drive signals are not supplied becomes relatively short.

During the period t13, the first switcher 49 is controlled and brought into a connected state. During the period t23, the second switcher 50 is controlled and brought into a disconnected state. As indicated by the bold line shown in FIG. 6, the third waveform section PS3 of the first drive signal COM1 is supplied to the piezoelectric vibrator 21. As a result, the second middle dot drive pulse DP2 is supplied to the piezoelectric vibrator 21, whereby a small amount of ink corresponding to a middle dot is ejected.

In the embodiment, even in the case of a medium-dot recording gradation, portions of the waveform elements constituting the first drive signal COM1 (i.e., the third constant potential element P9, the first expanding element P10, the expansion holding element P11, the first election element P12, the damping hold element P13, and the damping element P14) and a portion of the waveform element constituting the second drive signal COM2 (i.e., the fourth constant potential element P21) are supplied, in combination, to the piezoelectric vibrator 21. During a period of time during which the first drive signal COM1 cannot be supplied to the piezoelectric vibrator 21 (the periods t11, t12), the fourth constant potential P21 of the second drive signal COM2 is supplied, thereby maintaining the potential of the vibrator at the intermediate potential Vhm.

This is intended for shortening, to the greatest possible extent, the period of time during which the drive signals COM1, COM2 are not supplied to the piezoelectric vibrator 21. More specifically, when a printer is used at high humidity or the insulation resistance of the piezoelectric element has dropped as a result of long-term use of the piezoelectric vibrator 21, an electric-charge retaining capability of the piezoelectric vibrator 21 may drop. When a drop has arisen in the electric-charge retaining capability of the piezoelectric vibrator 21, the potential of the piezoelectric vibrator 21 is gradually lowered by electric discharge which arises during a period of time in which the drive signals are not supplied to the vibrator. Therefore, when the period of time during which the drive signals are not supplied to the vibrator is long, the extent to which the potential of the vibrator is decreased becomes larger. When the next drive signals are supplied to the vibrator, a difference between the potential of the drive signal and the potential of the vibrator becomes greater. In this case, abrupt deformation arises in the piezoelectric vibrator 21, thereby causing erroneous ejection of an ink droplet.

As in the case of this embodiment, so long as the period of time during which the drive signals COM1, COM2 are not supplied to the vibrator is shortened to the greatest possible extent, the extent to which the potential of the vibrator drops can be made smaller even when a drop has arisen in the electric-charge retaining capability of the vibrator. Hence, the drive signals COM1, COM2 can be supplied without any trouble.

There will now be described the case of recording of large dots. In this case, the decoder 45 generates first waveform selection data [1111] and second waveform selection data [0000] by translating gradation data [11 ] pertaining to large dots. In accordance with the thus-generated waveform selection data, the switch controller controls supply of the first drive signal COM1 and the second drive signal COM2 to the piezoelectric vibrator 21.

Specifically, during the period t10 (t20), the first adjustment element P0 is supplied to the piezoelectric vibrator 21, and the potential of the vibrator is adjusted to the intermediate potential Vhm. During the periods t11 to t13, the first switcher 49 is controlled and brought into a connected state. During the periods t21 to t23, the second switcher 50 is controlled and brought into a disconnected state. As a result, during the period t11, the first waveform section PS1 is supplied to the piezoelectric vibrator 21. During the period t12, the second waveform section PS2 is supplied to the piezoelectric vibrator 21. Further, during the period t13, the third waveform section PS3 is supplied to the same. More specifically, the first middle dot drive pulse DP1 and the second middle dot drive pulse DP2 are supplied to the piezoelectric vibrator 21.

Figure 7:
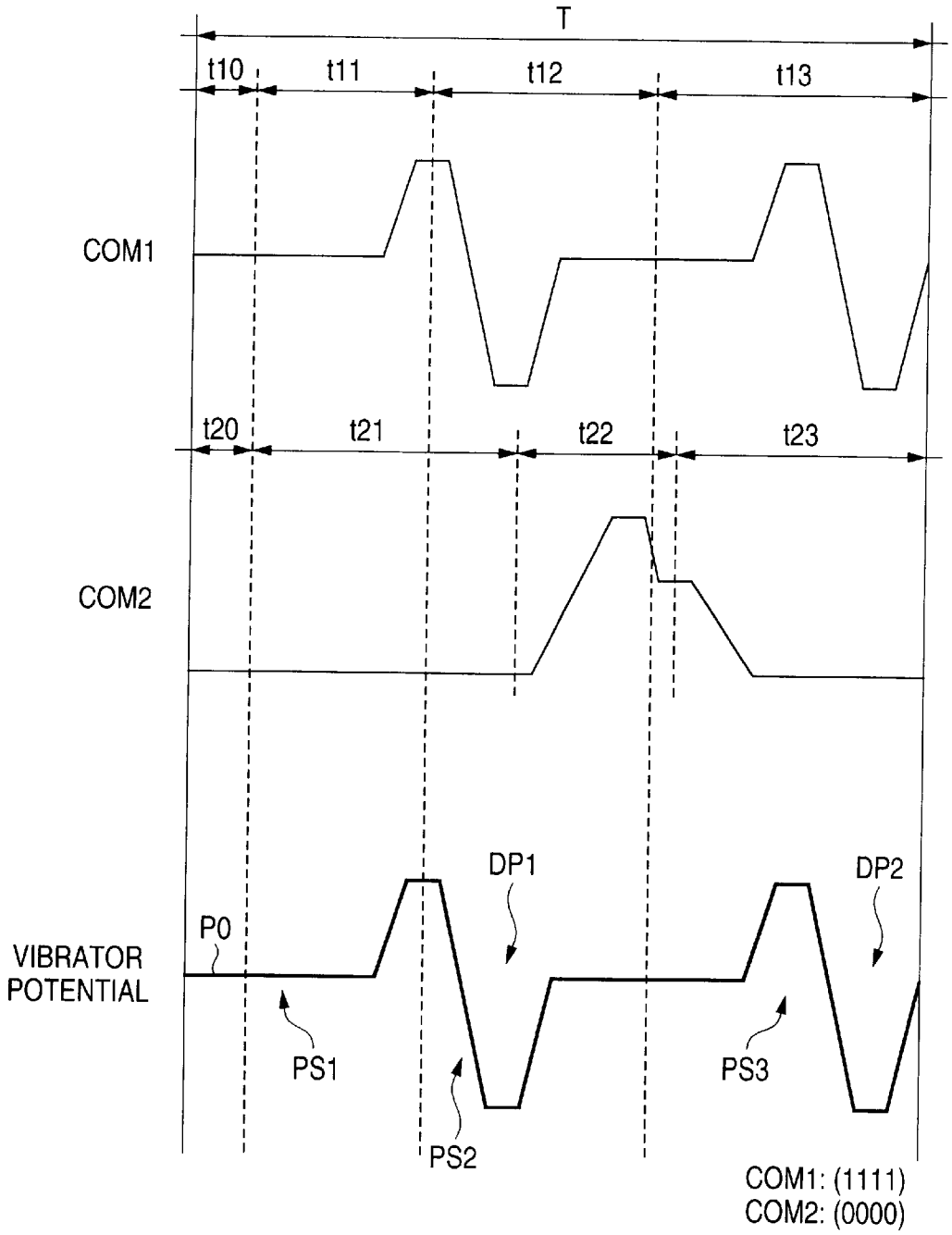
FIG. 7 is a diagram for describing control of supply of a drive signal at the time of large dot recording operation.

Consequently, as indicated by a bold line shown in FIG. 7, the potential of the vibrator is changed in accordance with the first drive signal COM1, and a small amount of ink is continuously ejected from the nozzle orifice 32 twice in response to the middle dot drive pulse. Large dots are recorded by these ink droplets.

As has been described, in the embodiment, two middle dot drive pulses DP1, DP2 are included in the first drive signal COM1. One small dot drive pulse DP3 is included in the second drive signal COM2. A period of time during which the middle dot drive pulses DP1, DP2 are generated and a period of time during which the small dot drive pulse DP2 is generated partially overlap each other, thereby shortening the recording cycle T. As a result, the piezoelectric vibrator 21 can be driven at a higher frequency, thereby enabling the recording head 8 to provide sufficient performance.

Since a portion of the waveform elements constituting the first drive signal COM1 and a portion of the waveform elements constituting the second drive signal COM2 are supplied, in combination, to the piezoelectric vibrator 21, the recording head can be driven in accordance with a new pattern which is not explicitly specified by the drive signals. For example, a meniscus can be minutely vibrated without use of a dedicated vibrating pulse. Moreover, periods during which no drive signals are supplied to the piezoelectric vibrator 21 can be shortened to the shortest possible extent. As a result, a complicated control operation can be achieved while the recording head 8 is actuated at a higher frequency.

Figure 8:
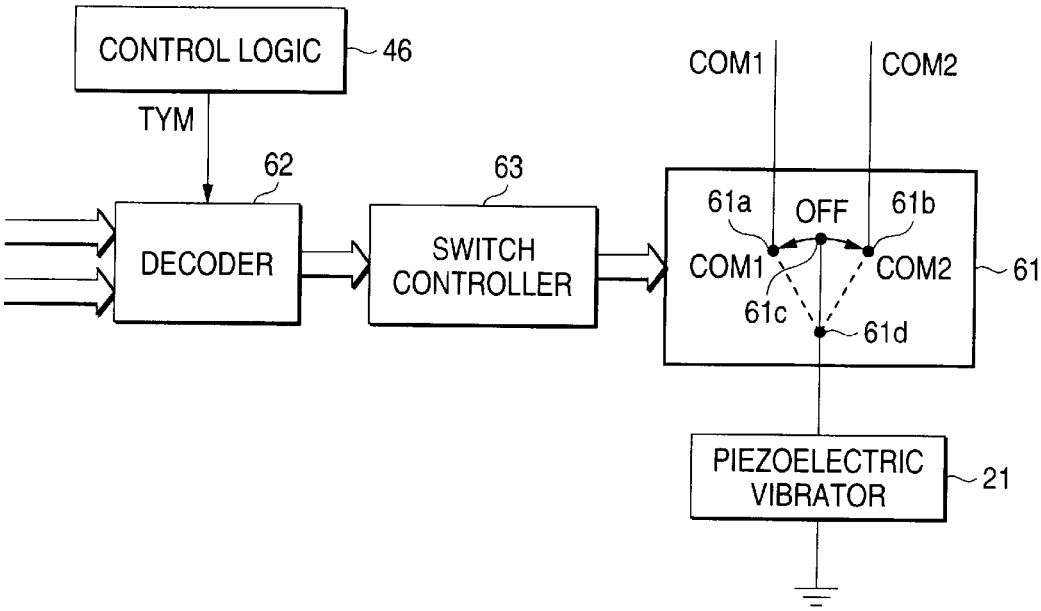
FIG. 8 is a block diagram showing a switcher an ink jet recording apparatus according to a second embodiment of the invention.

In this embodiment, the drive signals COM1, COM2 are selectively supplied to the piezoelectric vibrator 21 by the first and second switchers 49, 50 that are provided in accordance with the types of drive signals to be generated. However, the invention is not limited to such a switcher. For instance, the drive signals COM1, COM2 may be selectively supplied to the piezoelectric vibrator 21 by a changeover switch shown in FIG. 8 as a second embodiment of the invention.

The changeover switch 61 is provided for each of the piezoelectric vibrators 21. The changeover switch 61 has a first input contact point 61*a*, a second input contact point 61*b*, an off-contact point 61*c*, all being provided in accordance with the types of drive signals to be generated, and an output terminal 61*d* to be electrically connected to the piezoelectric vibrator 21. One of the contact points 61*a* through 61*c* is selectively, electrically connected to the output terminal 61*d*. The first input contact point 61*a* is electrically connected to a line for feeding a first drive signal COM1; the second input contact point 61*b* is electrically connected to a line for feeding a second drive signal COM2; and the off-contact point 61*c* has no electrical connection.

The drive signals COM1, COM2 can be selectively supplied to the piezoelectric vibrator 21 by switching the contact points 61*a* through 61*c*, all being electrically connected to the output terminal 61*d*. Specifically, the first drive signal COM1 can be supplied by electrically connecting the first input contact point 61*a* to the output terminal 61*d*. The second drive signal COM2 can be supplied by electrically connecting the second input drive signal COM2 to the output terminal 61*d*. Neither the first drive signal COM1 nor the second drive signal COM2 is supplied when the off-contact point 61*c* is electrically connected to the output terminal 61*d*.

The operation of the changeover switch 61 is controlled by the decoder 62 and the switch controller 63. The decoder 62 serves as a switching data generator and generates switching data representing any one of the first input contact point 61*a* ([1]), the second input contact point 61*b* ([2]), and the off-contact point 61*c* ([0]) by translation of recording data (gradation data). The switching data are output to the switch controller 63 in synchronism with a timing output from the control logic 46'.

An explanation will be given by reference to a drive signal shown in FIG. 3. In the case of gradation data [00] the decoder 62 generates switching data [110002]. The switching data are output to the switch controller 63 at a start timing of period t10 (t20), a start timing of the period t11 (t21), a start timing of the period t12, a start timing of a period t22, a start timing of a period t13, and a start timing of a period t23.

During the periods t10 and t11, the changeover switch 61 is electrically connected to the first input contact point 61*a*, whereby the first adjustment element P0 and the first waveform section PS1 of the first drive signal COM1 are supplied to the piezoelectric vibrator 21. Subsequently, the changeover switch 61 is switched to the off-contact point 61*c* immediately before the period t23, whereby supply of a drive signal is interrupted. During the period t23, the changeover switch 61 is switched to the second input contact point 61*b*, whereby the sixth waveform section PS6 of the second drive signal COM2 is supplied to the piezoelectric vibrator 21.

Consequently, as in the case of the embodiment, the meniscus vibrating operation can be effected.

In the case of the gradation data [01], the decoder 62 generates switching data [42222]. As a result, the changeover switch 61 is electrically connected to the second input contact point 61*b* over the entire period of the recording cycle T. The second adjustment element P20, the fourth waveform section PS4, the fifth waveform section PS5, and the sixth waveform section PS6 are supplied to the piezoelectric vibrator 21.

Consequently, as in the case of the embodiment, an amount of ink corresponding to a small dot can be ejected.

In the case of the gradation data [10], the decoder 62 generates switching data [222011]. As a result, the changeover switch 61 is electrically connected to the second input contact point 61*b* immediately before start of the period t22, whereupon the second adjustment element P20 and the fourth waveform section PS4, both belonging to the second drive signal COM2, are supplied to the piezoelectric vibrator 21. The changeover switch 61 is switched to the off-contact point 61 from a start point of the period t22 to a point immediately before start of the period t13, thereby interrupting supply of a drive signal. Subsequently, the changeover switch 61 is switched to the first input contact point 61*a* during the period t13, whereupon the third waveform section PS3 of the first drive signal COM1 is supplied to the piezoelectric vibrator 21.

Consequently, as in the case of the embodiment, an ink droplet corresponding to a middle dot can be ejected.

In the case of the gradation data [11], the decoder 62 generates switching data [111111]. As a result the changeover switch 61 is electrically connected to the first input contact point 61*a* over the entire period of the recording cycle T. The first adjust element P0, the first waveform section PS1, the second waveform section PS2, and the third waveform section PS3, all belonging to the first drive signal COM1, are supplied to the piezoelectric vibrator 21.

Consequently, as in the case of the embodiment, an ink droplet corresponding to a large dot can be ejected.

By such a configuration, control of one changeover switch 61 with regard to one piezoelectric vibrator 21 is sufficient, and hence simplification of control of the switcher can be attempted.

Here, the invention is not limited to the above-described embodiment and is susceptible to various modifications within the scope of the invention defined by the appended claims.

In connection with the pressure generating element, the embodiment has described a case where the piezoelectric vibrator 21 of so-called longitudinal vibration mode is used. However, the invention can be carried out in the same manner, through use of a piezoelectric vibrator of so-called deflection vibration mode. Alternatively, an electrostatic actuator may be used in addition to a piezoelectric vibrator.

The embodiment has described the two types of drive signals COM1, COM2. However, even when three or more types of drive signals are generated, the invention can be carried out in the same manner.

The invention can be applied to plotters, facsimiles, copiers, or various types of ink jet recording apparatuses, as well as to printers.

The invention can be also applied to display manufacturing apparatuses, electrode forming apparatuses, biochip manufacturing apparatuses, or various types of liquid jetting apparatuses, as well as ink jet recording apparatuses. In such cases, one ordinary skilled in the art can easily realize that the words "ink", "recording", "small dot", "medium dot", "large dot" and "recording gradation" used in the foregoing explanations may be respectively replaced with "liquid", "jetting", "small droplet", "medium droplet", "large droplet" and "jetting amount".

What is claimed is:

1. A liquid jetting apparatus, comprising:

a jetting head, provided with a nozzle orifice, a pressure chamber communicated with the nozzle orifice, and a piezoelectric element which is deformable to cause pressure fluctuation to liquid contained in the pressure chamber;

a drive signal generator, which simultaneously generates a plurality of drive signals, each provided with waveform elements including at least one drive pulse in every unit jetting cycle, the drive pulse deforming the piezoelectric element to cause such pressure fluctuation as to eject a liquid droplet from the nozzle orifice;

a switcher, which selectively supplies at least one of the waveform elements included in one of the drive signals to the piezoelectric element; and a switch controller, which controls a selective supply operation of the switcher in accordance with amount data which indicates an amount of the liquid droplet to be ejected, wherein a time period in which the drive pulse is generated in one of the drive signal and that in another one of the drive signals overlap at least partly.

2. The liquid jetting apparatus as set forth in claim 1, wherein the waveform elements in each drive signal include a drive waveform element which constitutes the drive pulse, and a constant-potential waveform element which maintains a potential of the drive signal at a leading-end potential and a trailing-end potential thereof.

3. The liquid jetting apparatus as set forth in claim 2, wherein the switch controller controls the switcher such that the drive waveform element in one of the drive signals and the drive waveform element in another one of the drive signals are supplied to the piezoelectric element in the unit jetting cycle.

4. The liquid jetting apparatus as set forth in claim 2, the switch controller controls the switcher such that the drive waveform element in one of the drive signals and the constant-potential waveform element in another one of the drive signals are supplied to the piezoelectric element in the unit jetting cycle.

5. The liquid jetting apparatus as set forth in claim 2, wherein the switch controller controls the switcher such that the constant-potential waveform element in at least one of the drive signals is supplied to the piezoelectric element in the unit jetting cycle.

6. The liquid jetting apparatus as set forth in claim 1, wherein the switcher includes a plurality of switches interposed between the drive signal generator and the piezoelectric element such that each of the switches is associated with one of the drive signals.

7. The liquid jetting apparatus as set forth in claim 6, wherein the switch controller selectively activates one of the switches such that one of the drive signals associated with an activated switch is supplied to the piezoelectric element.

8. The liquid jetting apparatus as set forth in claim 1, wherein:

the switcher includes a plurality of input contacts each associated with one of the drive signals and an output contact electrically connected to the piezoelectric element; and the switch controller selectively connects one of the input contacts and the output contact such that one of the drive signals associated with a selected input contact is supplied to the piezoelectric element.

9. The liquid jetting apparatus as set forth in claim 1, wherein:

the drive signals include:

a first drive signal, in which at least two first drive pulses each for ejecting a first amount of liquid droplet are arranged at a predetermined interval; and a second drive signal, in which at least one second drive pulse for ejecting a second amount of liquid droplet is generated at a timing between timings at which the first drive pulses are generated; and the predetermined interval is determined such that the first drive pulses are still arranged at the predetermined interval even when the first drive signal is successively selected in adjacent unit jetting cycles.

10. The liquid jetting apparatus as set forth in claim 9, wherein:

the first drive pulse including:

an expanding element, in which a potential of the first drive signal is varied from a reference potential to a first potential at a constant gradient, so that a volume of the pressure chamber is expanded from a reference volume to a first volume; and a first holding element, which maintains the volume of the pressure chamber at the first volume;

the second drive pulse including:

second holding element, in which a potential of the second drive signal is maintained at the first potential to maintain the volume of the pressure chamber at the first volume; and a contracting element, in which the potential of the second drive signal is varied from the first potential to the reference potential at a constant gradient, so that the volume of the pressure chamber is contracted from the first volume to the reference volume; and the switch controller controls the switcher so as to supply the expanding element, the first holding element, the second holding element and the contracting element, to cause pressure fluctuation such an extent that no liquid droplet is ejected, when the amount data indicates no jetting is to be performed.

11. The liquid jetting apparatus as set forth in claim 9, wherein:

each of the first drive pulses is interposed between first constant-potential waveform elements which maintain a potential of the first drive signal at a reference potential so that an initial end and a termination end of each first drive pulse are set to the reference potential;

the second drive pulse is interposed between second constant-potential waveform elements which maintain a potential of the second drive signal at the reference potential so that an initial end and a termination end of the second drive pulse are set to the reference potential; and the switch controller controls the switcher so as to supply one of the first drive pulses and one of the second constant-potential waveform element, so that a potential of the piezoelectric vibrator is set to the reference potential while the first drive pulse is not supplied, when the amount data indicates the first amount of liquid droplet to be ejected.

12. A method of driving a liquid jetting apparatus which comprises a jetting head, provided with a nozzle orifice, a pressure chamber communicated with the nozzle orifice, and a piezoelectric element which is deformable to cause pressure fluctuation to liquid contained in the pressure chamber, the method comprising the steps of:

generating simultaneously a plurality of drive signals, each provided with waveform elements including at least one drive pulse in every unit jetting cycle, the drive pulse deforming the piezoelectric element to cause such pressure fluctuation as to eject a liquid droplet from the nozzle orifice;

providing a switcher which selectively supplies at least one of the waveform elements included in one of the drive signals to the piezoelectric element; and controlling a selective supply operation of the switcher in accordance with amount data which indicates an amount of the liquid droplet to be ejected, wherein a time period in which the drive pulse is generated in one of the drive signal and that in another one of the drive signals overlap at least partly.

* * * * *